US005427190A

United States Patent [19]

Mo

[11] Patent Number: 5,427,190

[45] Date of Patent: Jun. 27, 1995

[54] UNDERGROUND BORER WITH DOWN HAMMER

[75] Inventor: Jeon J. Mo, 1-803, Sang-A APT, 166, Ogeum-Dong, Song-pa Gu, Seoul, Rep. of Korea

[73] Assignees: Kencho Kobe Co., Ltd., Osaka, Japan; Jeon Jin Mo, Seoul, Rep. of Korea

[21] Appl. No.: 234,879

[22] Filed: Apr. 28, 1994

[30] Foreign Application Priority Data

Jun. 1, 1993 [KR] Rep. of Korea ..... 9415/1993

[51] Int. Cl.[6] ..... E21B 7/02

[52] U.S. Cl. ..... 175/205; 175/296

[58] Field of Search ..... 175/205, 296, 415, 418, 175/122, 162, 135, 203, 215

[56] References Cited

U.S. PATENT DOCUMENTS 5,213,169 5/1993 Heller ..... 175/122

FOREIGN PATENT DOCUMENTS 55-23272 2/1980 Japan .
55-113786 2/1980 Japan .
55-119885 9/1980 Japan .
1640326 4/1991 U.S.S.R. ..... 175/135

*Primary Examiner*—William P. Neuder
*Attorney, Agent, or Firm*—Armstrong, Westerman, Hattori, McLeland & Naughton

[57] ABSTRACT

In an underground borer with down hammer having a vehicle body 1, a guide stilt 2 standing on the vehicle body, and a rotary machine 4 having its bottom coupled with a screw shaft 3 and a down hammer B, a supply unit 5 is interposed between the rotary machine 4 and the screw shaft 3, a fluid conduit 6 is formed centrally of the screw shaft 3, compressed air conduits 7 and 7' are formed to surround the fluid conduit 6, and a fluid jetting pipe 8 is arranged centrally of the down hammer B to extend until the inside of a bit body 9 so that water may be discharged, along with high-pressure compressed air, from a central portion of the bottom surface of the bit body during boring to cool the bit body, promote anti-wear properties, suppress powdery dirts, reduce noises and increase the boring speed.

3 Claims, 4 Drawing Sheets

UNDERGROUND BORER WITH DOWN HAMMER

BACKGROUND OF THE INVENTION

1. Field of the Invention

The present invention relates to an underground borer with down hammer and more particularly to an underground borer in which a fluid jetting pipe is arranged centrally of a down hammer of the borer so that fluid may be discharged, along with compressed air, from the bottom portion of a bit body to the outside of the borer.

2. Description of the Prior Art

Known for a conventional underground borer with down hammer or a method of construct ion using the same is a technique disclosed in Japanese Patent Application Laid-open No. Sho 55-119885 wherein a hammer excavating head is coupled to a ram of an oil pressure cylinder suspended so as to be free to ascend and descend, a circuit for feeding pressurized oil is connected to the oil pressure cylinder and that circuit is connected with a high pressure relief valve and with a low pressure relief valve through a switching valve, whereby by determining setting pressures of the two relief valves to proper values, ground pressure received by a spiking bit can be adjusted to a value which allows the spiking bit to move vertically; or a technique disclosed in Japanese Utility Model Application Laid-open No. Sho 55-113786 wherein an air hammer having a spiking bit attached to the fore end of a screw auger is mounted on its outer periphery with a spiral screw blade whose diameter is increased upwardly gradually and the screw blade is mounted with an excavating cutting edge, whereby even with a small-diametered or size-reduced air hammer, a hole of a large diameter can be excavated. A method of construction for boring has also been known as disclosed in Japanese Patent Application Laid-open No. Sho 55-23272, according to which in a borer wherein a piston operated by compressed air is attached to the bottom of a drill pipe and a bit is mounted to the piston so as to be moved vertically, a nozzle having a check valve directed laterally is disposed in the lower end of the drill pipe so that as excavation effected by the borer proceeds, mortar or the like is blown from the nozzle against a bored hole wall so as to be forcibly deposited thereon.

In the conventionally known underground borers the bit body inside the down hammer reciprocated under the application of compressed air to bore a rock by the hammer act ion but heat is generated by friction between the bit body and the rock to raise the temperature of the bit body and as a result anti-wear properties of the bit body is degraded within relatively short period of time. In addition, since powdery dirt is are generated in the course of boring to pollute workers as well as environmental circumstances and the hammer in operation generates a roaring noise, reduction of powdery dirt and reduction of noises are needed. Further, the boring speed is not always satisfactorily high.

SUMMARY OF THE INVENTION

An object of the present invention is to eliminate the above disadvantages of the conventionally known underground borers and more specifically, it is an object of the present invention to provide an underground borer with down hammer which can improve the durability of a bit body used for a down hammer and which can reduce powdery dirt and noises.

Another object of the present invention is to provide a unit of supplying fluid used for the underground borer with down hammer and capable of perfecting the periphery of a hole which is apt to collapse.

To solve the above problems and to accomplish the above objects, an underground borer with down hammer according to the present invention basically has a vehicle body 1, a guide stilt 2 standing on the vehicle body 1, and a rotary machine 4 having its bottom coupled with a screw shaft 3 and a down hammer B, where in a supply unit 5 is interposed between the rotary machine 4 and the screw shaft 3, a fluid conduit 6 is formed centrally of the screw shaft 3, compressed air conduits 7 and 7' are formed to surround the fluid conduit 6, and a fluid jetting pipe 8 in communication with the fluid conduit 6 is arranged centrally of the down hammer B to extend, preferably, until the inside of a bit body 9, whereby fluid is discharged, along with compressed air, from the bottom portion of the bit body to the outside of the borer.

The kind of fluid used in the present invention by being supplied to the fluid conduit is not particularly limited and may be water, cement milk, bentonite or mortar.

In a preferable form of the supply unit 5, flanges 12 and 12' are coupled to upper and lower portions of a rotary member 11 so as to permit the rotary member to be connected between the rotary machine 4 and the screw shaft 3, an annular member 14 is applied around the outer periphery of the rotary member 11, bearings 15 and 15' are attached to upper and lower portions of the annular member 14, caps 16 and 16' are fixed by means of screw bolts 17 and 17', and a semicircular annular groove 18 formed in a middle part of contact surface of the rotary member 11 faces a semicircular annular groove 18' formed in a middle part of contact surface of the annular member 14, the one annular groove 18' being in communication with a compressed air supply source and the other annular groove 18 being communication with the compressed air conduits 7 and 7' formed in the screw shaft 3.

In the present invention, by causing fluid along with compressed air to jet out of the bottom portion of the down hammer of the underground borer with down hammer known as described previously, heat in the bit body can be cooled when water is used as fluid to promote the anti-wear properties of the bit body with the result that powdery dirt generated in the course of boring can be suppressed noises generated during boring can be reduced significantly, and in addition the boring speed can be increased when water is discharged along with high-pressure compressed air.

Further, when the fluid is cement milk, bentonite or mortar, the effect of preventing collapse of an excavated hole can also be attained to advantage.

DESCRIPTION OF THE PREFERRED EMBODIMENTS

An underground borer with down hammer will now be described in greater detail by way of example with reference to the accompanying drawings.

Figure 1:
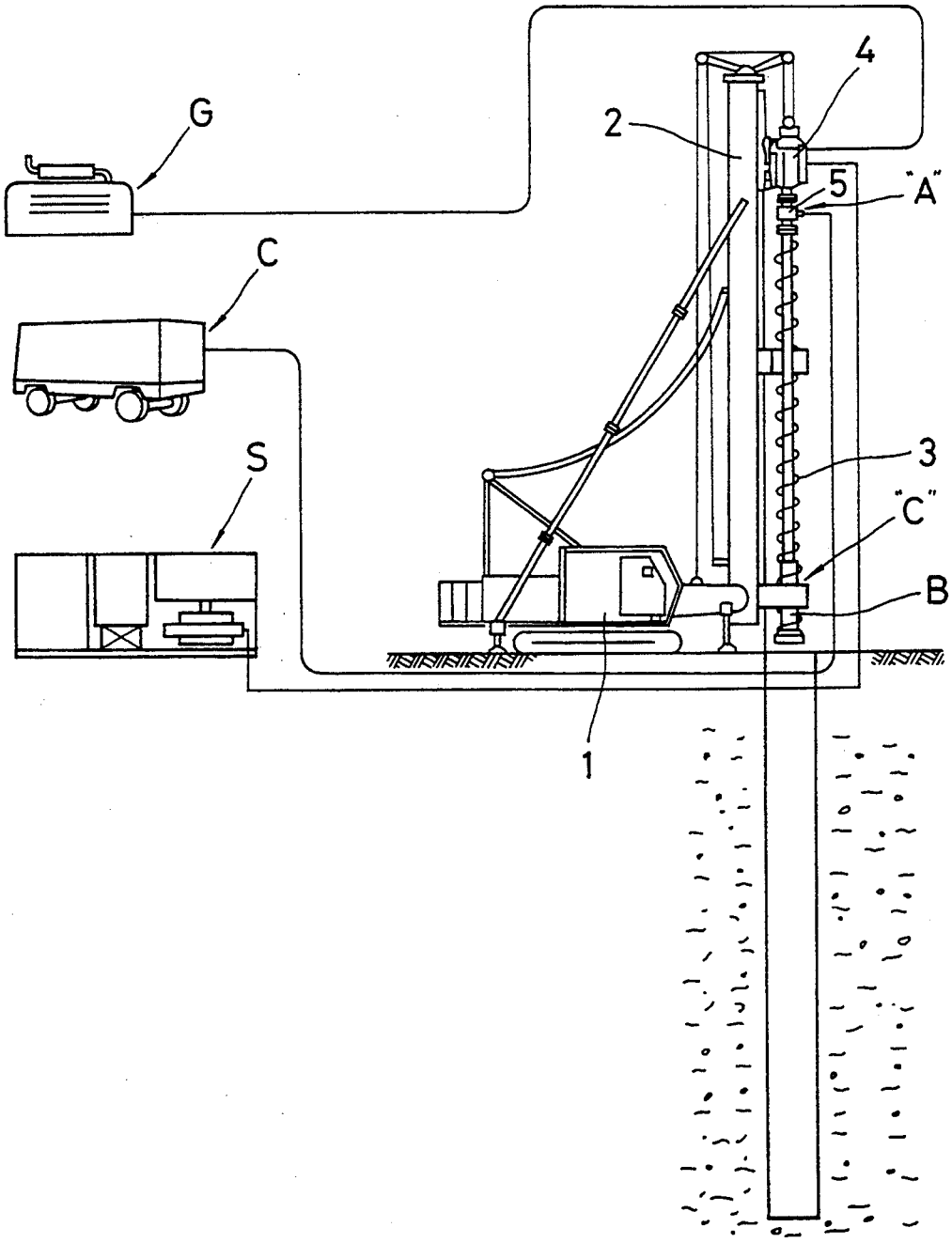
FIG. 1 is a side view showing the overall construction of an underground borer with down hammer according to the present invention.

Referring first to FIG. 1, a guide stilt 2 stands upright in front of a vehicle body 1, a screw shaft 3 and a rotary machine 4 operated by a generator G to rotate the screw shaft are disposed along the guide stilt 2, and a down hammer B formed with screw blades is connected to the bottom of the screw shaft 3. Interposed between the rotary machine 4 and the screw shaft 3 is a supply unit 5 capable of supplying compressed air from an air compressor C to the screw shaft 3.

The screw shaft 3 is formed, at its central portion, with a fluid conduit 6 for supplying water received from a water supplier S through the rotary machine 4 to the down hammer B and with compressed air conduits 7 and 7' for supplying compressed air received from the air compressor C through the supply unit 5 to the down hammer B.

The down hammer B is a conventionally known one including an outer sleeve 31A having its periphery provided with screw blades 30, a check valve 32 adapted to make and break the supply of compressed air fed from the compressed air conduits 7 and 7', a piston 33 operated by compressed air, an inner sleeve 31B for guiding compressed air to the working surface of the piston 33, a bit body 9 disposed at the fore end of the piston 33 and a compressed air jetting conduit 10 by which central portions of the piston 33 and bit body 9 communicate with each other, but it has a structure specific to the present invention in the following points.

More particularly, a fluid jetting pipe 8 passing through an opening 34 formed in the check valve 32 runs through a central portion of the down hammer B to extend in the compressed air jetting conduit 10 until the inside of the bit body 9. In addition, a plurality of compressed air supply conduits 36 and 36' are formed in an upper portion of the down hammer B to surround the fluid jetting pipe 8 and downstream fore ends of the supply conduits 36 and 36' join at a portion above the check valve 32 to form an annular supply conduit 37. The check valve 32 is urged to abut against the downstream end of the annular supply conduit 37.

Figure 4:
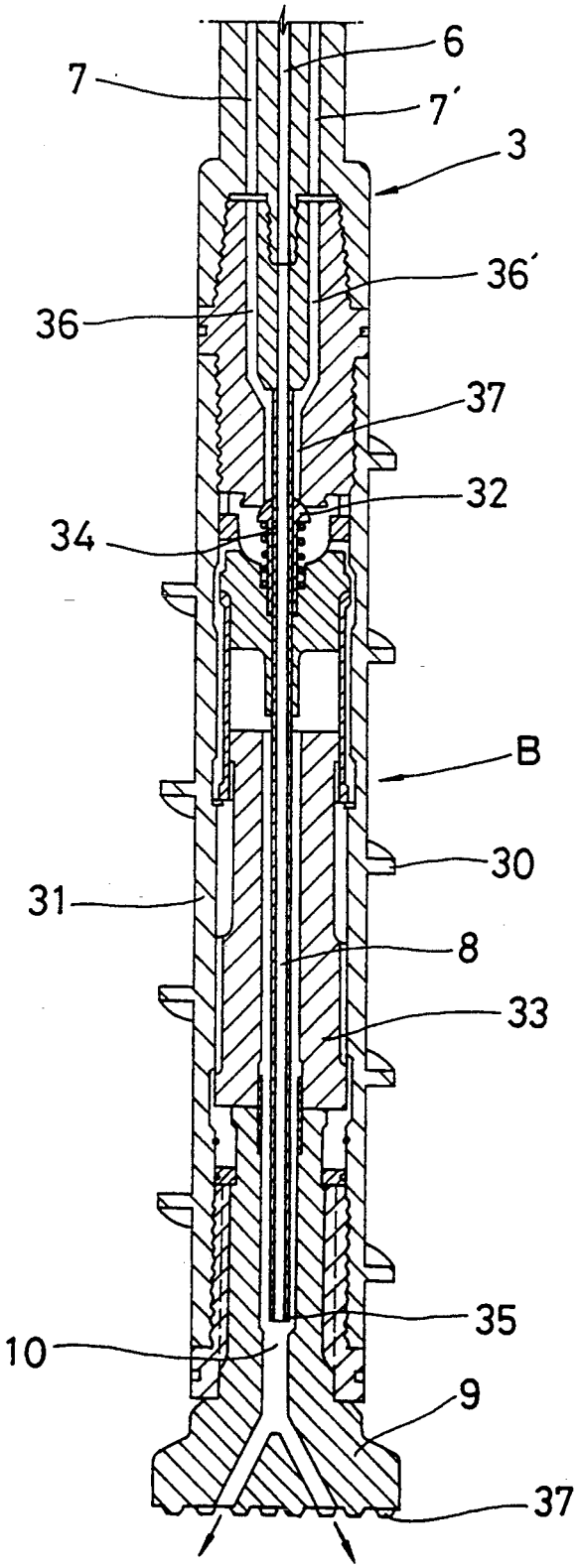
FIG. 4 is an enlarged longitudinal sectional view of a hammer illustrated at a portion C in FIG. 1.

As shown in FIG. 4, with the down hammer B mounted to the screw shaft 3, the fluid conduit 6 formed in the screw shaft 3 is in communication with the fluid jetting pipe 8 formed in the down hammer B, thereby establishing a liquid supply passage. The compressed air conduits 7 and 7' formed in the screw shaft 3 are also in communication with the compressed air supply conduits 36 and 36' formed in the down hammer B, thus ending in the compressed air jetting conduit 10. Then, water jetting out of a lower end 35 of the fluid jetting pipe 8 cooperates with compressed air discharged from the compressed air jetting conduit 10 to the periphery of the water to cause a water jet phenomenon and under this condition, water and compressed air jet out all together from the bottom of the bit body 9.

Figure 2:
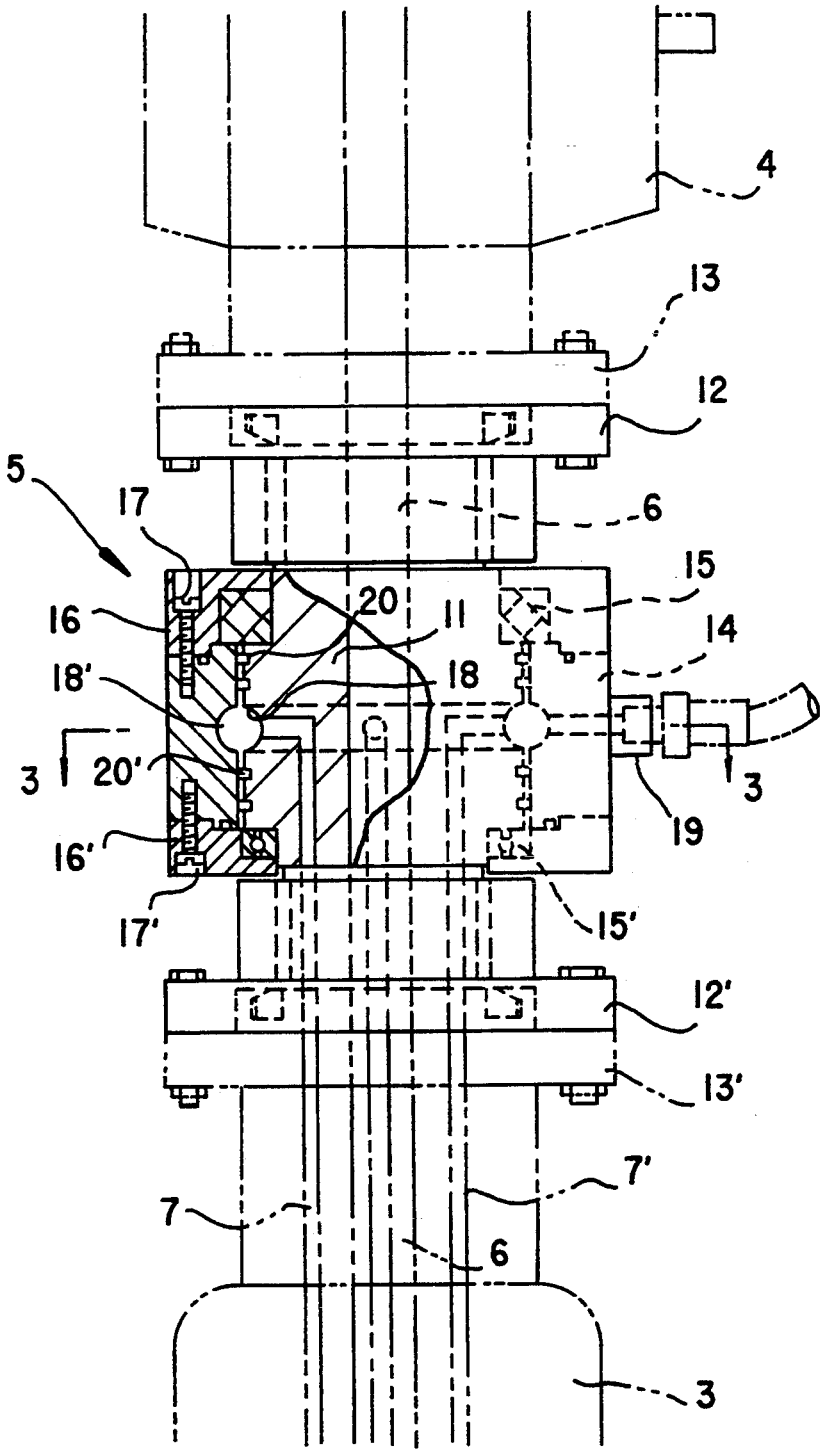
FIG. 2 is an enlarged partial sectional view showing a portion A of FIG. 1.

Next, the structure of the supply unit 5 will be described. As shown in FIG. 2, the supply unit 5 has a rotary member 11 having its upper and lower portions coupled to flanges 12 and 12', respectively, by means of keys. The upper flange 12 is connected to a flange 13 on the side of the rotary machine 4 and the lower flange 12' is connected to a flange 13' on the side of the screw shaft 3. An annular member 14 is set between the upper and lower flanges 12 and 12' and ring-shaped caps 16 and 16' are fixed by means of bolts 17 and 17' through bearings 15 and 15' arranged on upper and lower portions of the annular member 14. Through this, the annular member 14 can be prevented from rotating even when the rotary member 11 rotates.

Figure 3:
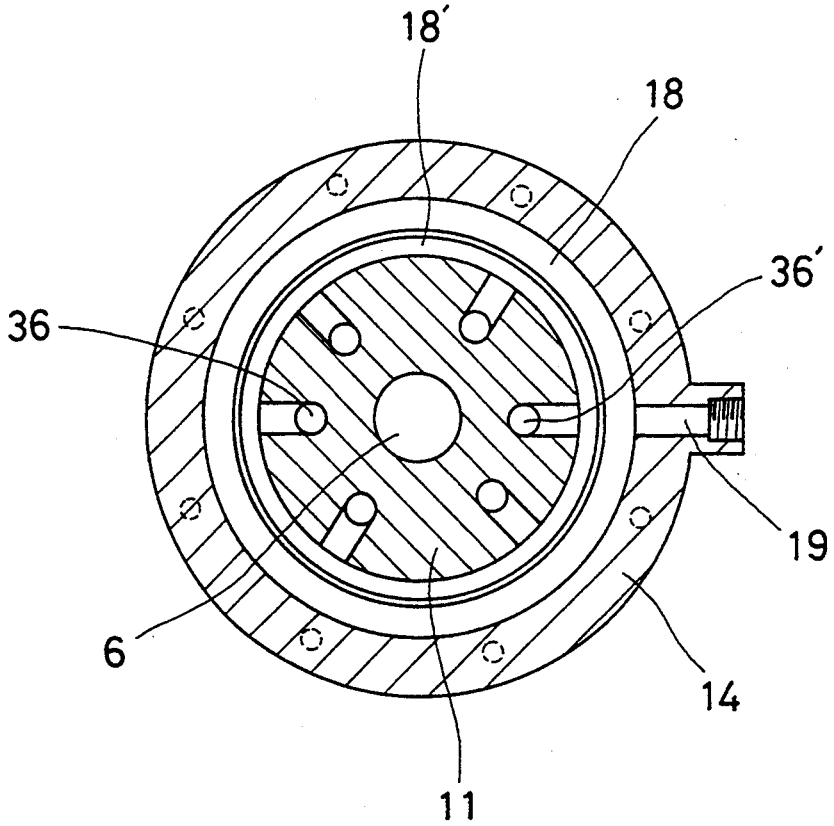
FIG. 3 is a cross-sectional view on line 3—3 of FIG. 2.

As shown in greater detail in FIGS. 2 and 3, a semicircular annular groove 18 formed in a middle part of contact surface of the rotary member 11 faces a semicircular annular groove 18' formed in a middle part of contact surface of the annular member 14, and the one annular groove 18 communicates with the compressed air conduits 7 and 7' formed in the screw shaft 3 and the other annular groove 18' communicates with an inlet/-outlet port 19 connected to the air compressor C serving as a supply source of compressed air. Denoted by reference numerals 20 and 20' are seal materials such as rubber rings which act to prevent leakage of compressed air.

In the underground borer with down hammer according to the present invention constructed as above, the rotary machine 4 and the down hammer B are operated to proceed with excavation work and when a rigid stratum or rock bed is reached, water is supplied from the water supplier S to the fluid conduit 6 formed centrally of the screw shaft 3. Supplied water then reaches the down hammer B and is caused to jet out of the lower end 35 of the fluid jetting pipe 8. A jet of water mixes there with compressed air running down in the compressed air jetting conduit 10 and used to drive the piston 33 of down hammer B and the bit body 9, causing a water jet phenomenon, and is blown off vigorously downwardly of the bit body 9.

In the underground borer with down hammer according to the present invention, instead of supplying water through the fluid supply conduit 6 as described previously, cement milk, bentonite or mortar may be supplied.

While in the illustrated embodiment the jetting pipe 8 is described as extending through the compressed air jetting conduit 10 until its fore end reaches the inside of the bit body 9, it is not always necessary that the fore end of the liquid jetting pipe 8 extend until the inside of the bit body 9 and the intended purpose can be accomplished if the fore end of the fluid jetting pipe lies inside the compressed air jetting conduit 10 formed in the down hammer 10, for example, at a portion inside the piston 33 operated by compressed air.

In the present invention, since many tips 38 embedded in the bottom surface of the bit body 9 so as to partly project therefrom can be cooled by supplied fluid (for example, water) as described previously, anti-wear properties can be promoted and powdery dirt can be prevented from scattering even when fractured and pulverized rock dirt is given off, thus improving the workability. Further attainable operational effects are such that when the hammer is operated for spiking, its shocks can be mitigated softly to reduce noise to a certain extent and the jet compression of water and air allows water to penetrate through a rock bed to thereby increase the boring speed.

In the present invent ion, when cement milk or the like is supplied as fluid through the fluid supply conduit 6 instead of supplying water as described previously, there is attained such an operational effect that the periphery of an excavated hole which is apt to collapse can be reinforced with cement.

What is claimed is:

1. An underground borer including a vehicle body, a guide stilt standing on said vehicle body, and a rotary machine having its bottom coupled with a screw shaft and a down hammer, a supply unit interposed between said rotary machine and said screw shaft, a fluid conduit extending axially through said screw shaft, compressed air conduits circumferentially spaced around said fluid conduit, and a fluid jetting pipe in communication with said fluid conduit and having an outlet disposed substantially centrally of a bit body of said down hammer, and a compressed air jetting conduit in communication with said outlet of said fluid jetting pipe and said compressed air conduits and having an outlet at a bottom portion of said bit body, whereby fluid is discharged in mixed relation with compressed air from the bottom portion of said bit body to the outside of said borer.

2. An underground borer having a vehicle body, a guide stilt standing on said vehicle body, and a rotary machine having its bottom coupled with a screw shaft and a down hammer, wherein a supply unit is interposed between said rotary machine and said screw shaft, a fluid conduit is formed centrally of said screw shaft, compressed air conduits are formed to surround said fluid conduit, and a fluid jetting pipe in communication with said fluid conduit is arranged centrally of said down hammer, whereby fluid is discharged, along with compressed air, from a bottom portion of a bit body to the outside of said borer, wherein in said supply unit, flanges are coupled to upper and lower portions of a rotary member so as to permit said rotary member to be connected between said rotary machine and said screw shaft, an annular member is applied around the outer periphery of said rotary member, bearings are attached to upper and lower portions of said annular member, caps are fixed by means of screw bolts, and a semicircular annular groove formed in a middle part of a contact surface of said rotary member faces a semicircular annular groove formed in a middle part of a contact surface of said annular member, said annular groove being in communication with a compressed air supply source and the other annular groove being in communication with said compressed air conduits formed in said screw shaft.

3. An underground borer including a down hammer having:

a main body, a bit body actuable by compressed air operative in said main body, a fluid jetting pipe and compressed air conduits extending axially through said main body, and a compressed air jetting conduit communicating with said fluid jetting pipe and said compressed air conduits and extending axially through said bit body, said compressed air jetting conduit having an opening at the bottom portion of said bit body, whereby fluid and compressed air are discharged from said opening to the outside of said down hammer.

* * * * *